US008989926B2

(12) United States Patent
Pretorius et al.

(10) Patent No.: US 8,989,926 B2
(45) Date of Patent: Mar. 24, 2015

(54) RAILROAD SIGNALING AND COMMUNICATION SYSTEM USING A FAIL-SAFE VOLTAGE SENSOR TO VERIFY TRACKSIDE CONDITIONS IN SAFETY-CRITICAL RAILROAD APPLICATIONS

(75) Inventors: Francois Pretorius, Paonia, CO (US); David L. Hill, Prospect, KY (US); Lawrence Deloss Lowe, III, Louisville, KY (US); Charles A. Wisniewski, Rancho Cucamonga, CA (US)

(73) Assignee: Convergent Communications, Inc., Paonia, CO (US)

( * ) Notice: Subject to any disclaimer, the term of this patent is extended or adjusted under 35 U.S.C. 154(b) by 847 days.

(21) Appl. No.: 12/620,942

(22) Filed: Nov. 18, 2009

(65) Prior Publication Data

US 2011/0118913 A1 May 19, 2011

(51) Int. Cl.

| | |
|---|---|
| ***G05D 1/00*** | (2006.01) |
| ***G01R 19/00*** | (2006.01) |
| ***G08B 21/00*** | (2006.01) |
| ***G08G 1/123*** | (2006.01) |
| ***B61L 27/00*** | (2006.01) |

(52) U.S. Cl.

CPC ..... *B61L 27/0088* (2013.01)
USPC ..... 701/19; 702/64; 340/540; 340/679; 340/988; 246/3; 246/28 R; 246/34 R; 246/122 R; 246/167 R; 246/169 A; 246/186; 246/187 A; 246/187 B; 246/220

(58) Field of Classification Search

USPC ..... 701/19; 702/64; 340/540, 679, 988; 246/3, 28 R, 34 R, 122 R, 167 R, 169 A, 246/186, 187 A, 187 B, 220

See application file for complete search history.

(56) References Cited

U.S. PATENT DOCUMENTS

| | | | | |
|---|---|---|---|---|
| 4,467,430 | A * | 8/1984 | Even et al. | 701/117 |
| 4,550,444 | A * | 10/1985 | Uebel | 340/10.34 |
| 5,092,544 | A * | 3/1992 | Petit et al. | 246/126 |
| 5,098,044 | A * | 3/1992 | Petit et al. | 246/187 A |
| 5,376,925 | A * | 12/1994 | Crisafulli et al. | 340/665 |
| 5,420,883 | A * | 5/1995 | Swensen et al. | 375/138 |
| 5,446,451 | A * | 8/1995 | Grosskopf, Jr. | 340/682 |
| 7,075,427 | B1 * | 7/2006 | Pace et al. | 340/539.22 |
| 2003/0015626 | A1 * | 1/2003 | Wolf et al. | 246/187 A |
| 2007/0208841 | A1 * | 9/2007 | Barone et al. | 709/223 |
| 2008/0142645 | A1 * | 6/2008 | Tomlinson et al. | 246/122 R |

* cited by examiner

*Primary Examiner* — James Trammell
*Assistant Examiner* — Majdi Alsomiri
(74) *Attorney, Agent, or Firm* — Wyatt, Tarrant & Combs, LLP; Matthew A. Williams

(57) ABSTRACT

A method and system for verifying trackside conditions in safety critical railroad applications by reporting the status of trackside signals and switches to a remote train control system. The system comprises at least one sensor for providing trackside conditions electrically connected to a circuit for providing trackside conditions to a railroad, said sensor being powered by voltage applied to the circuit such that the sensor is energized only when said electrical component is engaged. The system and method further comprises a method and system which is failsafe and which enables the control system to independently verify signals from each sensor.

13 Claims, 5 Drawing Sheets

RTCS = Remote Train Control System
ACGA = Authentication Code Generation Algorithm

RAILROAD SIGNALING AND COMMUNICATION SYSTEM USING A FAIL-SAFE VOLTAGE SENSOR TO VERIFY TRACKSIDE CONDITIONS IN SAFETY-CRITICAL RAILROAD APPLICATIONS

RELATED APPLICATIONS

Not applicable.

STATEMENT REGARDING SPONSORED RESEARCH OR DEVELOPMENT

Not applicable.

REFERENCE TO A MICROFICHE APPENDIX

Not applicable.

FIELD OF THE INVENTION

The present invention relates to railroad signaling and communication. More specifically, the present invention relates to a fail-safe verification system and method for providing trackside conditions to a remote train control system, located on a locomotive or at a central office, to monitor visual signals or switch positions as used by the train engineer. Trackside conditions are monitored by sensing the voltage between railroad interlockings and trackside signaling electrical components which the interlocking uses to determine the track status and authorize train movement.

BACKGROUND OF THE INVENTION

Rail systems utilize the same tracks for two way traffic. Trackside signals indicating various track conditions are used by engineers, dispatchers, and computerized control systems to control access to the tracks and prevent conflicting train movements. Switches placed throughout the rail system divert traffic from the main track to side tracks (sidings) allowing trains to pass one another or to change the train's route. Switches are also utilized in rail yards to change the train's route. At the switch, the rails of the track are mechanically moved to successfully divert the train to the new track. The locomotive engineer visually monitors track signals located trackside to determine the status of the track switches and to obtain authority to enter a specific track section and takes action, for instance adjusting the speed of the train when signals indicate the train will be diverted to a siding due to switch positions. Since safety-critical decisions are made based on the status of the switches and signals, a system and method are needed to ensure that any signal and switch status is reported correctly. Due to the potential for operator error, it is beneficial for railroads to electronically verify the status of switches and signals along the track by communicating the status of these signals to a system on-board the locomotive. Based on the information received, the on-board system can monitor the speed and location of the train and override the engineer by, for example, applying the brakes if the train's authorized speed profile is in danger of being exceeded. Those of skill in the art will recognize that this system of electronically monitoring and controlling train movements to provide increased rail safety is commonly referred to as Positive Train Control.

Railroad signaling systems include complex interlockings which are arrangements of signaling apparatus (e.g. relays, software logic, etc.) that prevent conflicting train movements through an arrangement of tracks. By way of example, some of the fundamental principles of interlocking include: signals may not be operated to permit conflicting train movements to take place at the same time; switches in a route must be properly 'set' (in position) before a signal may allow train movements to enter that route; once a route is set and a train is given a signal to proceed over that route, all switches in the route are locked in position until either the train passes out of the portion of the route affected, or the signal to proceed is withdrawn and sufficient time has passed to ensure that a train approaching that signal has had opportunity to come to a stop before passing the signal. Interlockings can be categorized as mechanical, electrical (relay-based), or electronic (software-based).

Trackside input electrical components such as switch contacts and hazard detectors are electrically connected to the interlocking and provide track condition information as inputs to the interlocking. When the input electrical component needs to provide an input to the interlocking, voltage is applied to the connection or a contact closes a circuit, thereby sending a track condition input to the interlocking. The interlocking processes the multiple track condition inputs it receives and determines track status. The interlocking is electrically connected to output electrical components such as signals. The interlocking identifies the output electrical components to be energized based on the track status, and applies voltage to the connection between the interlocking and the particular output electrical components.

The prior art verification system for reporting the status of switches and signals to a remote train control system to confirm visual signals comprises a trackside central control unit with its own independent power supply and microprocessor. The central control unit is electrically connected via wiring or some similar physical method to each of a plurality of trackside electrical components, and can sense a combination of electrical voltages and currents in these components. The microprocessor of the central control unit continuously monitors the electrical components to measure their electric current and/or voltage and determines track conditions such as which signal lamps are on, the positions of switches, and the state of any other hazard detectors. It is critical in the prior art system that these electric measurements are correct. There are many outside influences such as lightning strikes, electrical surges, etc., that could effect the accuracy of the electric measurements. For this reason, the central control unit includes many additional, and often redundant, components such as duplicate sensors, multi-path processors, redundant input circuits and board, dual processing boards and additional software to ensure the accuracy of the electric readings. These prior art central control units are expensive due, in large part, to the additional components and software needed to ensure the accuracy of the electric readings.

One disadvantage of the prior art system is that it requires expensive, safety-validated software for the microprocessor and significant testing to ensure that all failure modes have been addressed. Maintaining such a software development process for the lifetime of the product burdens it with significant cost. A second disadvantage of the existing system is that the microprocessor is centrally mounted in a trackside bungalow, and a significant amount of wiring is needed to reach the various sensing points. This adds cost to the deployment into existing bungalows.

It is an objective of the present invention to provide a fail safe voltage sensor for verifying the status of trackside signals and switches in safety-critical railroad applications which eliminates the need for duplicative components to account for all potential errors and failures. Another objective of the present invention is to provide a cost effective, single input sensor to replace more expensive, multi-input equipment used in prior art systems. Another objective of the present invention is to provide a sensor with low power consumption which allows for longer battery life of the overall trackside control system. The trackside installations including the trackside signals and switches, the interlocking, the central control unit and other components are typically powered by a bank of batteries located at the trackside installation. Yet another objective is to provide a voltage sensor which can be installed near to each electrical component to be sensed thereby greatly reducing the amount of wiring needed to connect the prior art multi-input systems to each electrical component and the cost of installing and testing these large lengths of wire.

SUMMARY OF THE INVENTION

The system comprises at least one microprocessor-based voltage sensor for providing trackside conditions to a remote train control system which controls train movement. The sensor is electrically connected to a trackside circuit for providing trackside conditions to a railroad interlocking. The trackside circuit further comprises a trackside signaling electrical component and an interlocking. Examples of trackside signaling electrical components which may be included in the trackside circuit are switch contacts, hazard detectors, such as snow and flood detectors, and signal lamps, but those of skill in the art will recognize that there are many trackside signaling electrical components which may be employed. In one embodiment, the sensor is electrically connected to the circuit between the electrical component (input electrical component) and the input of the interlocking. When the input electrical component closes the circuit via electrical contact or applies voltage across the circuit, voltage is also applied across the sensor. In another embodiment, the sensor is electrically connected to the circuit at the output of the interlocking and the input of the electrical component (output electrical component). When the interlocking applies voltage to the circuit to power the output electrical component, voltage is also applied to the sensor. The sensor does not have an independent power supply and, because the sensor is electrically connected to the circuit, the sensor is powered by the voltage present in the energized circuit.

The sensor is capable of two-way electronic communication with a remote train control system, for example a remote computer system located on-board a locomotive or in a centralized office. The remote train control system is used to control train movement. Because the sensor is powered solely by the voltage of the energized circuit that it is connected to, i.e. the same voltage powering the visual signal or, in a case of a trackside switch, the voltage controlled by the contacts in the track switch enclosure, the sensor cannot transmit a message unless the circuit is energized, thereby eliminating the chance of false messages. The remote train control system uses the sensor status information to determine track status and control the movement of the locomotive. It is critical that the information on track status be accurate; therefore, the elimination of false messages from the verification system is very beneficial.

In one embodiment the electronic communication means is a wireless communication means. Such wireless communication galvanically isolates the input sensors from each other and from the other electrical components. Because the sensors are electrically isolated, the chance of undesirable short-circuits allowing energy from one circuit to feed into another is eliminated.

In another embodiment, the system further comprises a trackside master microprocessor capable of two way communication with multiple sensors and with the train control system. In this embodiment, all the sensors communicate with a single master microprocessor. The master microprocessor compiles all messages received from the various sensors into a single, aggregate message which it transmits to the remote train control system. Likewise, the remote train control system transmits messages which are received by the master microprocessor.

To protect the system from corrupted messages or messages from the wrong source reaching the remote train control system, each sensor in the system of the present invention is programmed and configured with a unique key and an authentication code generation algorithm (not unique). The remote train control system is pre-programmed with knowledge of the trackside circuit to which each sensor is connected, the unique key identifying each individual sensor and the authentication code generation algorithm. To verify track status for use in controlling train movement, the remote train control system will transmit a challenge message requesting sensor status. All energized sensors will receive the challenge message and each sensor will generate a unique authentication code, utilizing the sensor's unique key and then transmit the authentication code to the remote train control system. The remote train control system validates the received message by independently generating the authentication code for each sensor using a priori knowledge of each sensor's unique key. The remote train control system compares the received authentication codes with its independently generated authentication codes to validate the message. If the received authentication code matches the independently generated authentication code, the remote train control system validates the message and accepts that the sensors that reported are indeed active. The remote train control system associates the active sensors with the circuits using the pre-programmed knowledge of which sensors are connected with particular circuits in the remote train control system and confirms the track conditions based on which sensors are active. The remote train control system makes other decisions regarding train movement based on the verified track conditions.

Those of skill in the art will recognize that many different authentication code generation technologies could be used to create authentication codes and many different transmission schemes could be employed to transmit the authentication codes from the sensors to the remote train control system. In one embodiment, each sensor is pre-programmed and configured with a unique private key and a Hashed Message Authentication Code (HMAC) algorithm. The remote train control system is pre-programmed with knowledge of the circuit to which each sensor is connected, a unique key for each sensor and the HMAC algorithm. To verify track status, the remote train control system will transmit a challenge message requesting sensor status. All energized sensors will receive the challenge message and generate an HMAC code unique to the particular sensor using the unique key and HMAC algorithm, then transmit the HMAC code to the remote train control system. The remote train control system validates the received HMAC codes using the pre-programmed unique keys and the HMAC algorithm. If the HMAC code is valid, the remote train control system is able to confirm the track conditions based on which sensors are energized.

In another embodiment, each sensor communicates with a master microprocessor. The authentication code validation technology, such as an HMAC algorithm, is not programmed into the master microprocessor and the master microprocessor is not capable of authenticating the messages from the sensors. The remote train control system transmits a challenge message requesting sensor status to the trackside master microprocessor which in turn transmits a challenge message requesting sensor status to multiple sensors. Any energized sensors receive the challenge message from the trackside master microprocessor and generate an authentication code unique to the particular sensor. The energized sensors transmit their authentication codes to the master microprocessor. The master microprocessor compiles all authentication codes received from the various sensors into an aggregate authentication message which it transmits to the remote train control system. The master microprocessor is not programmed to authenticate the sensor messages. The trackside master microprocessor merely forwards the authentication codes to the remote train control system. The remote train control system validates the aggregate authentication code message using the pre-programmed unique keys and the authentication code generation algorithm. If the authentication code is valid, the remote train control system is able to confirm the track conditions based on which sensors are energized and use this information to control train movement.

For example, in one embodiment, the energized sensors generate a HMAC unique to the particular sensor using the sensor's unique key and the HMAC generation algorithm. The energized sensors transmit the HMAC to the trackside master microprocessor. The trackside master microprocessor compiles all HMACs received from the various sensors into a single, aggregate authentication message which it transmits to the remote train control system. The remote train control system validates the received HMAC by comparing the received codes to its independently generated HMAC created using the unique keys of the reporting sensors and the HMAC generation algorithm. If the received HMAC matches the remote train control system's independently generated HMAC, then the remote train control system accepts the validity of the active sensors reporting and correlates the active sensors and sensor locations to confirm the track status.

In an alternative embodiment, the sensors are arranged into clusters such that each cluster is related to a specific train route. For example, a certain section of track may have a first cluster of sensors for eastbound movement and a second cluster of sensors for westbound movement. Each cluster has a trackside master microprocessor pre-programmed with the number of sensors in its cluster. The master microprocessor in the cluster sequentially polls each sensor in its cluster when it receives a challenge message from the remote train control system. The master microprocessor reports aggregate authentication codes to the remote train control system. Since all sensors across all clusters have globally unique keys, the remote train control system may use the pre-programmed sensor key and sensor location information to validate sensors in the same cluster or across multiple clusters.

Utilizing the master microprocessor to transmit an aggregate message to the remote train control system is beneficial because it reduces the bandwidth used without sacrificing data security. System security is maintained even with the introduction of the additional trackside master microprocessor because the master microprocessor can not generate any valid authentication codes.

In another embodiment, each authentication code generated by each sensor takes, as input to the authentication code generation algorithm, a non-repeating number such as a time stamp, to protect against stale messages that might reach the remote train control system. When the remote train control system receives the authentication code, it validates the authentication code using both the sensor's unique key and the non-repeating number. If the non-repeating number is timely, the authentication code is validated. If the non-repeating number is not timely, the authentication code is discarded and the remote train control system sends another challenge message requesting sensor status.

The verification system and method of the present invention allows cost effective, single-chip microprocessors to be deployed as single input (single bit) fail-safe voltage sensors, replacing more expensive, multi-input prior art sensing equipment. Each sensor of the present invention is located near the electrical component it is sensing, thus obviating the need for wiring between each sensing point and a central communications controller as in the prior art equipment. The single-chip, single input arrangement of microprocessors as a fail-safe voltage sensor provides: protection against false reporting of a trackside circuit status (energized vs. non-energized), fast cycle time from application of power to the sensor to the reporting of energized status, flexible arrangement of multiple sensors into clusters for combining status messages reporting; and low power consumption and control over external communications devices to manage sleep-mode mechanisms for longer battery life at trackside installations which is particularly important at solar powered installations, and in embodiments utilizing wireless communications means, galvanic isolation of the input to be monitored from other circuits and power sources.

DETAILED DESCRIPTION OF THE INVENTION

Figure 1:
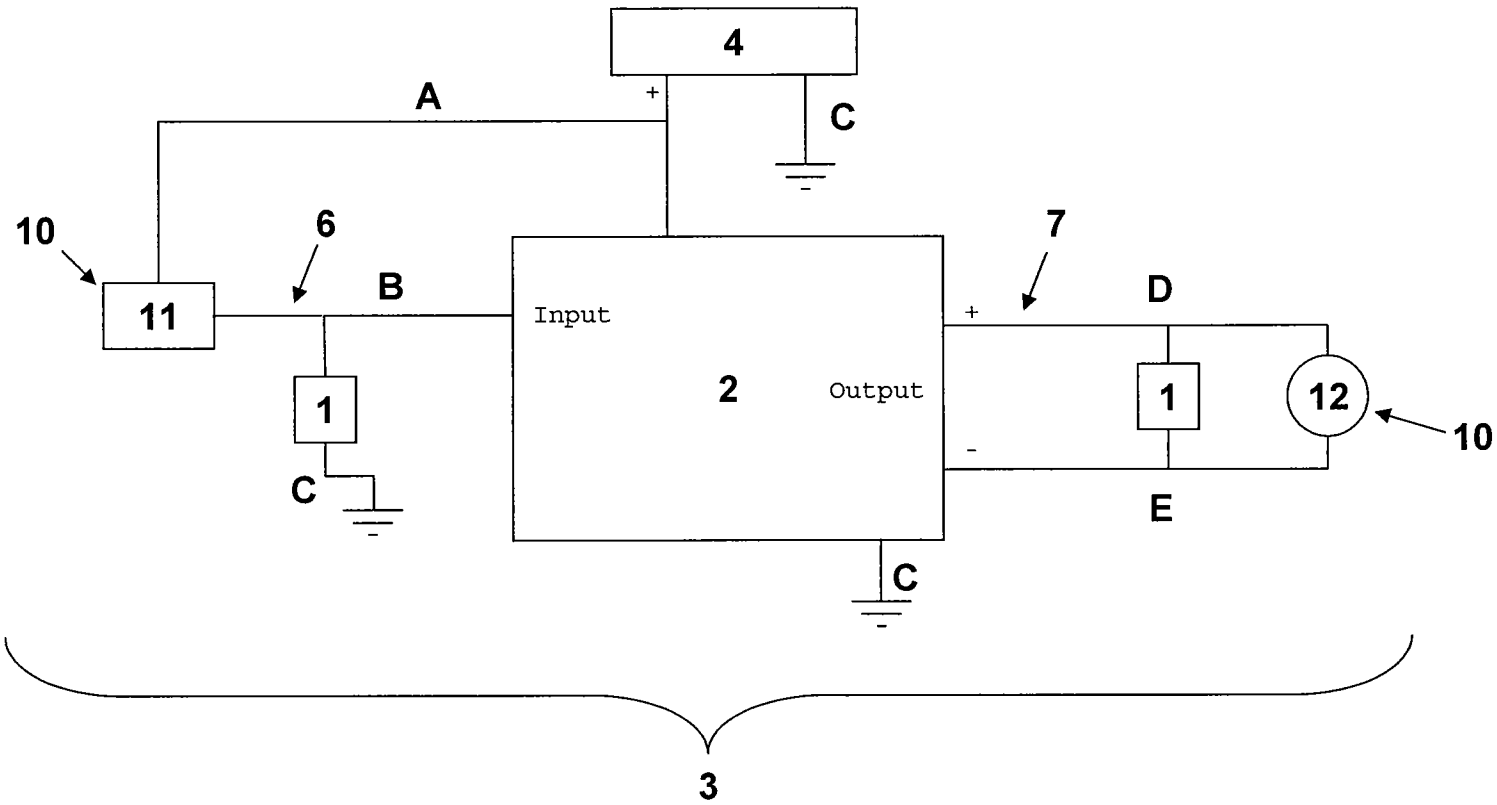
FIG. 1 is an illustration showing the components of the railroad signaling and communication system for verifying trackside conditions of the present invention as interconnected to an interlocking attached to a track circuit.

Referring now to FIG. 1, the verification system 3 of the present invention comprises at least one voltage sensor 1 for providing trackside conditions to a remote train control system 50 (see FIG. 2) electrically connected to a trackside circuit for providing trackside conditions to a railroad interlocking 2, said circuit comprising a power supply 4, an interlocking 2, and a trackside signaling electrical component 10. Each of the at least one sensors 1 corresponds to a different electrical component 10. A plurality of sensors 1 and electrical components 10 may be electrically connected to the same railroad interlocking 2 and power supply 4 creating a plurality of circuits. The voltage sensor 1 is powered by the voltage from the circuit and has no independent power supply; therefore, it is energized only when the electrical component 10 is engaged and the circuit is energized. In one embodiment, the trackside signaling electrical component 10 is an input electrical component 11 connected to an input of the interlocking 2. Those of skill in the art will recognize that there are many types of input electrical components 11 utilized in a railroad signaling system which provide inputs to an interlocking, for example, relays, switch contacts and hazard detectors (e.g. snow detectors, avalanche detectors, high water detectors, broken track detectors, etc.). The input electrical component 11 is electrically connected to interlocking 2 creating input circuit 6. In a circuit, a node is a place where circuit elements are connected to one another. The input circuit 6 has at least three nodes: A, B, and C. The input electrical component 11 is positioned between nodes A and B; the sensor 1 is positioned between nodes B and C; the interlocking 2 is positioned between nodes A, B, and C; the power supply 4 is positioned between nodes A and C. A positive terminal of the power supply 4 is adjacent to node A and a negative terminal of the power supply 4 is positioned adjacent to node C. When the input electrical component 11 is engaged (switch contact is connected, hazard detector is engaged, etc.), voltage is applied to input circuit 6, input circuit 6 and voltage sensor 1 are energized, and input electrical component 11 provides an input to interlocking 2. The input correlates to a certain track condition (switch in position, broken track, train present, etc.).

In another embodiment, the electrical component 10 is an output electrical component 12 which is electrically connected to an output of the interlocking 2. Those of skill in the art will recognize that there are many types of output electrical components 12 utilized in a railroad signaling system which receive outputs from an interlocking, for example, signals. Interlocking 2 is electrically connected to the output electrical component 12 creating output circuit 7. In a circuit, a node is place where circuit elements are connected to one another. The output circuit 7 has at least four nodes: A, C, D, and E. The interlocking 2 is positioned between nodes A, C, D, and E. The sensor is positioned between nodes D and E. The output electrical component 12 is positioned between nodes D and E. The power supply 4 is positioned between nodes A and C. A positive terminal of the power supply 4 is adjacent to node A and a negative terminal of said power supply 4 is adjacent to node C. The interlocking 2 determines the track status based on received inputs and, based on that status, the output to send to the output electrical component 12, for example authorizing entry to a certain track section, alerting the engineer that a switch is in the position for a siding, warning of high water on the track and prohibiting entry to a certain track section, indicating a reduced speed limit, etc.

In yet another embodiment, the interlocking 2 is electrically connected to at least one input electrical component 11 creating an input circuit 6 and at least one output electrical component 12 creating an output circuit 7.

Those of skill in the art will recognize that the power supply 4 can be any D.C. power supply, for example a battery or bank of batteries. The sensor 1 for providing trackside conditions to a remote train control system 50 has a low power, single-chip microprocessor. The present invention allows cost effective single-chip microprocessors to be used as single input (single bit) fail-safe voltage sensors, replacing the more expensive, multi-input equipment used in prior art systems. Because the sensor 1 and the trackside signaling electrical component 10 of the system of the present invention are both powered by the voltage from the energized circuit for providing trackside conditions to the railroad interlocking 2, it is important that the sensor 1 uses a low amount of power and draws as little current from the circuit as possible so that there is enough current remaining to power the trackside signaling electrical component 10. Those of skill in the art will recognize that there are many suitable low power microprocessors. For example, a Texas Instruments CC1110 Microprocessor that at peak operating conditions consumes 50 milliamps or less of the current flowing through the energized circuit may be used.

Figure 2:
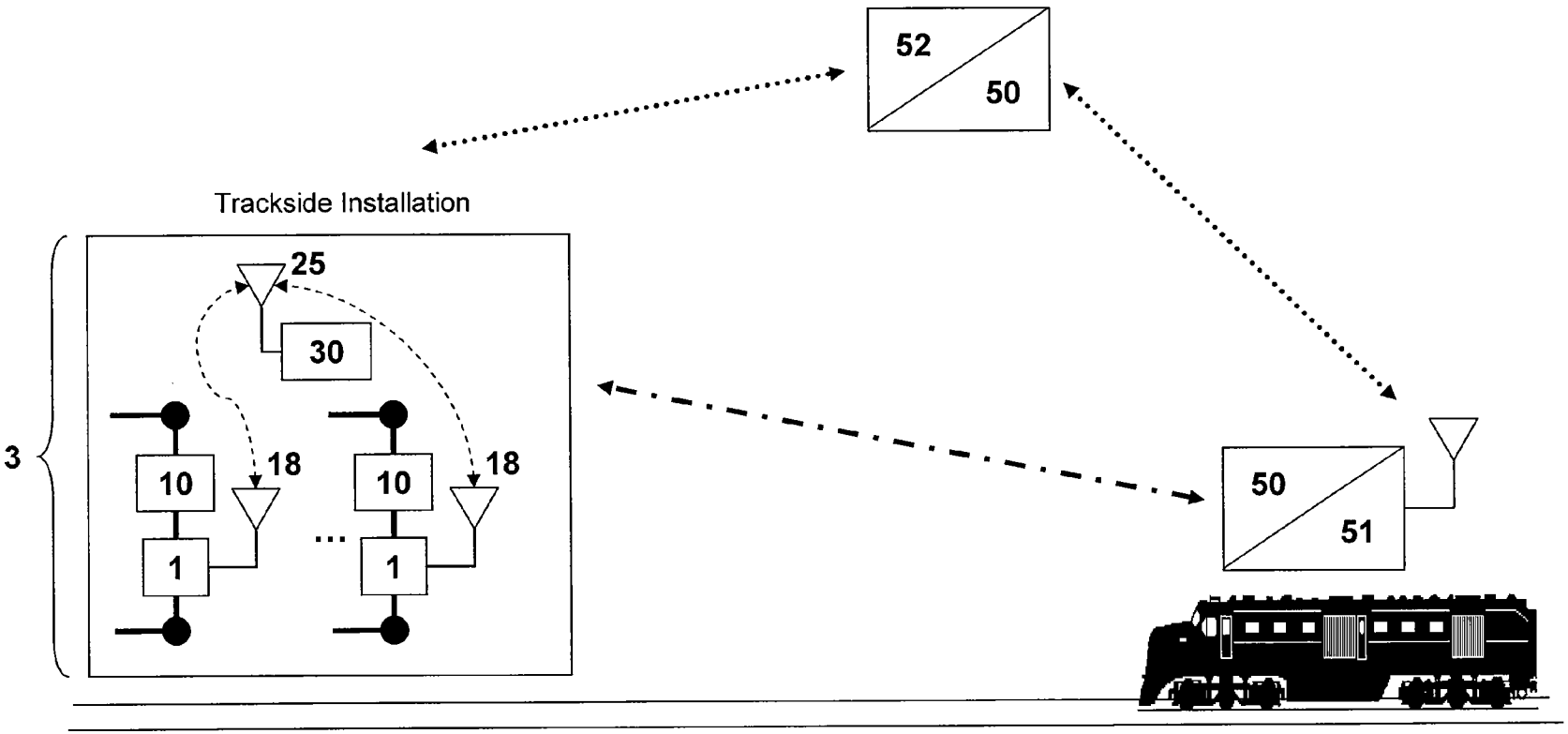
FIG. 2 is an illustration showing the components of the railroad signaling and communication system for verifying trackside conditions of the present invention at a single trackside installation in communication with the remote train control system.

Referring now to FIG. 2, the remote train control system 50 comprises a server and a database that act in a fail-safe (vital) manner to interpret the messages coming from the verification system 3 of the present invention. The verification system 3 reports the status of various sensors 1 (energized or de-energized). The server of the remote train control system 50 looks up the sensors 1 in the database and translates the status messages into actual rail information based on pre-programmed information. For example, a first sensor energized and a second sensor de-energized may mean that the switch is in the normal position. The remote train control system 50 then reports to the locomotive control system 51 the status of the electrical components 10 (e.g. that the switch is normal) using a different protocol. In one embodiment, the remote train control system 50 is located at a central office 52 and the central office server interprets the sensor status messages and sends translated control messages to the locomotive control system 51. In another embodiment, the remote train control system 50 is on-board the locomotive and the locomotive control system 51 receives the sensor status messages directly and interprets them.

The sensor 1 has an electronic communication means 18, and is capable of two-way electronic communication with a remote train control system 50 for controlling train movement, for example a system located on-board a locomotive 51 or in a centralized office 52. Because the sensor 1 for providing trackside conditions to the remote train control system 50 is powered solely by the voltage of the energized trackside circuit for providing trackside conditions to the railroad interlocking 2, the same voltage powering the trackside signaling electrical component 10, the sensor 1 cannot transmit a message unless the circuit is energized thereby eliminating the chance of false messages. The remote train control system 50 uses the sensor status information to verify visual signals and critical track conditions (switch contact energized, snow melter energized, signal authorizing entry to certain track, etc.) based on the status of the electrical components 10 which are used by the interlocking 2 to determine track status. The train engineer or remote train control system 50 ultimately uses the track status to control the movement of the locomotive; therefore, it is critical that the track condition information be accurate. The elimination of false messages from the verification system is very beneficial.

Those of skill in the art will recognize that there are many means of two-way electronic communication which can be utilized such as via serial port or by wireless communication means. Embodiments where wireless communication is used are beneficial because wireless communication galvanically isolates the sensors 1 from each other and from the other electrical components 10. Because the sensors 1 are electrically isolated, the chance of creating undesirable short-circuit paths allowing energy from one circuit to feed into another is eliminated.

One advantage of the verification system of the present invention is that it reduces the complexity of the equipment in comparison with prior art verification systems. Each single input microprocessor based voltage sensor 1 can be located in close proximity to the electrical component 10 output it is sensing. For example, the sensor 1 may be electrically connected to the electrical component 10 by a bracket or a short wire. The prior art, multi-input systems require long lengths of wire between the centrally located microprocessor and the electrical components which adds installation and maintenance costs to the prior art systems. An additional advantage of the present invention is that the low power consumption of each single input microprocessor based voltage sensor 1 provides for longer battery life at the trackside installation which is particularly helpful at solar powered installations. In some embodiments, the electronic communication means 18 has a transmitter and a receiver (not shown). The sensor microprocessor may be programmed to only power up the transmitter when it is sending a message thereby further reducing the power consumption of the verification system 3 and conserving battery life at the trackside installation.

Still referring to FIG. 2, in another embodiment, the system 3 further comprises a trackside master microprocessor 30 having a means for two way electronic communication 25 and capable of two way communication with both the sensors 1 and the remote train control system 50. Those of skill in the art will recognize that there are many suitable microprocessors which can be utilized as the master microprocessor 30 of the present invention. In some embodiments, a low power microprocessor is used as the master microprocessor 30. For example, a Texas Instruments CC1110 Microprocessor that at peak operating conditions consumes 50 milliamps or less of current can be used. It is beneficial to use a low power microprocessor in some embodiments to conserve battery life of the overall control system at the trackside installation. This is particularly beneficial at solar powered installations. The assigned sensors 1 and master microprocessor 30 are capable of two-way communication. The master microprocessor 30 compiles all messages received from the various sensors 1 into a single, aggregate authentication message which it transmits to the remote train control system 50. Likewise, the remote train control system 50 transmits messages to the master microprocessor 30. Those of skill in the art will recognize that there are many means of two-way electronic communication which can be utilized such as via serial port or by wireless communication means.

In some embodiments, the electronic communication means 25 of the master microprocessor has a transmitter and a receiver (not shown). The master microprocessor 30 may be programmed to only power up the transmitter when it is sending a message thereby further reducing the power consumption of the verification system and conserving battery life at the trackside installation.

Figure 3:
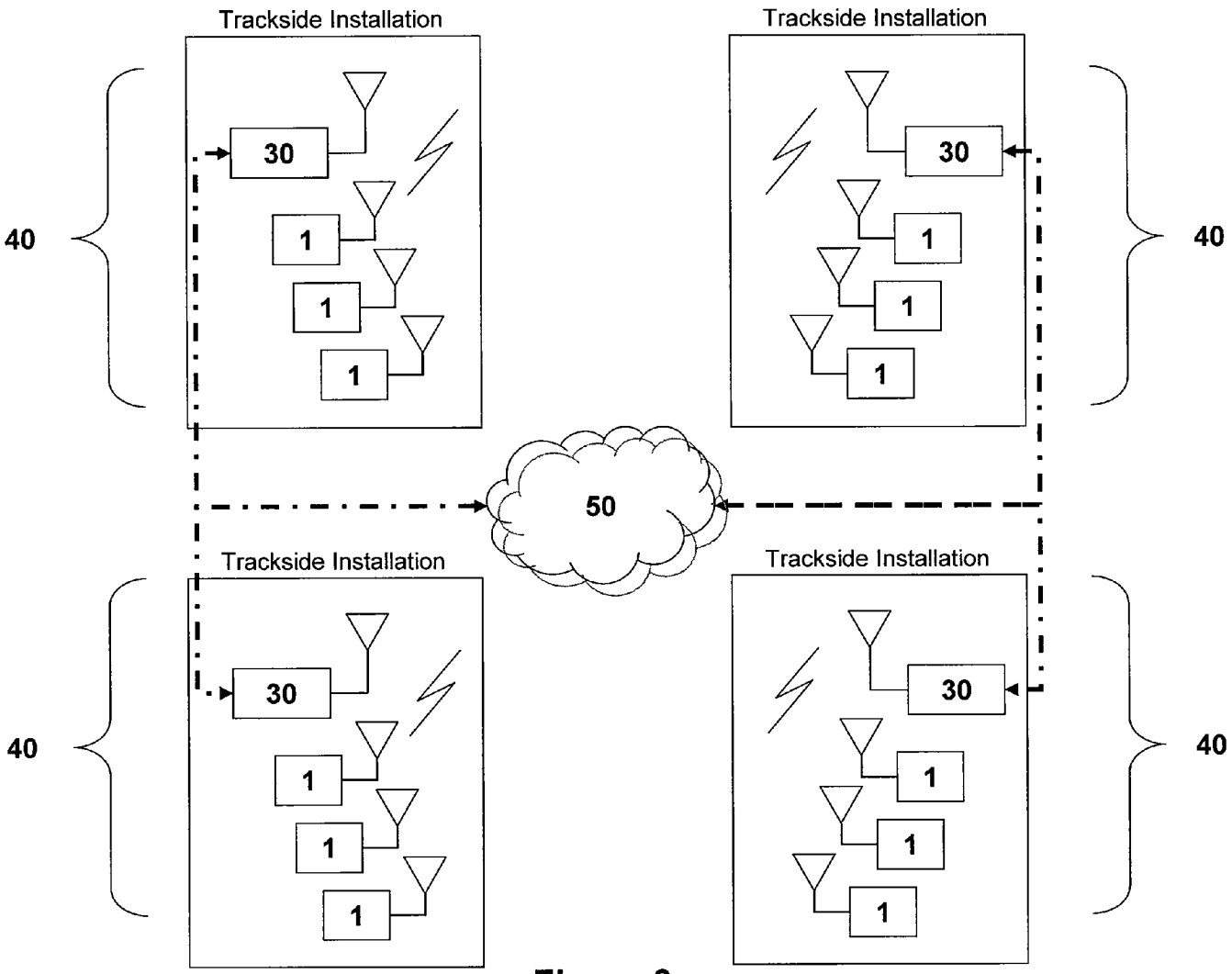
FIG. 3 is an illustration showing the components of the railroad signaling and communication system for verifying trackside conditions of the present invention at multiple trackside installations in communication with the remote train control system.

Referring now to FIG. 3, in some embodiments a cluster 40 of sensors 1 located in a particular trackside installation is assigned to a particular master microprocessor 30 also located at the trackside installation as shown in FIG. 3. The remote train control system 50 is pre-programmed to communicate with a particular master microprocessor 30 and cluster 40 at different times based on the locomotive's position and route. The present invention discloses an improved method for verifying track conditions in safety critical railroad applications by reporting the status of trackside signals and switches to a remote train control system to confirm visual signals and control train movement using the system 3 disclosed herein. The remote train control system 50 verifies the track status along the route of a particular locomotive by requesting and verifying the status of a certain sensor or sensors 1 located on its route.

Figure 4:
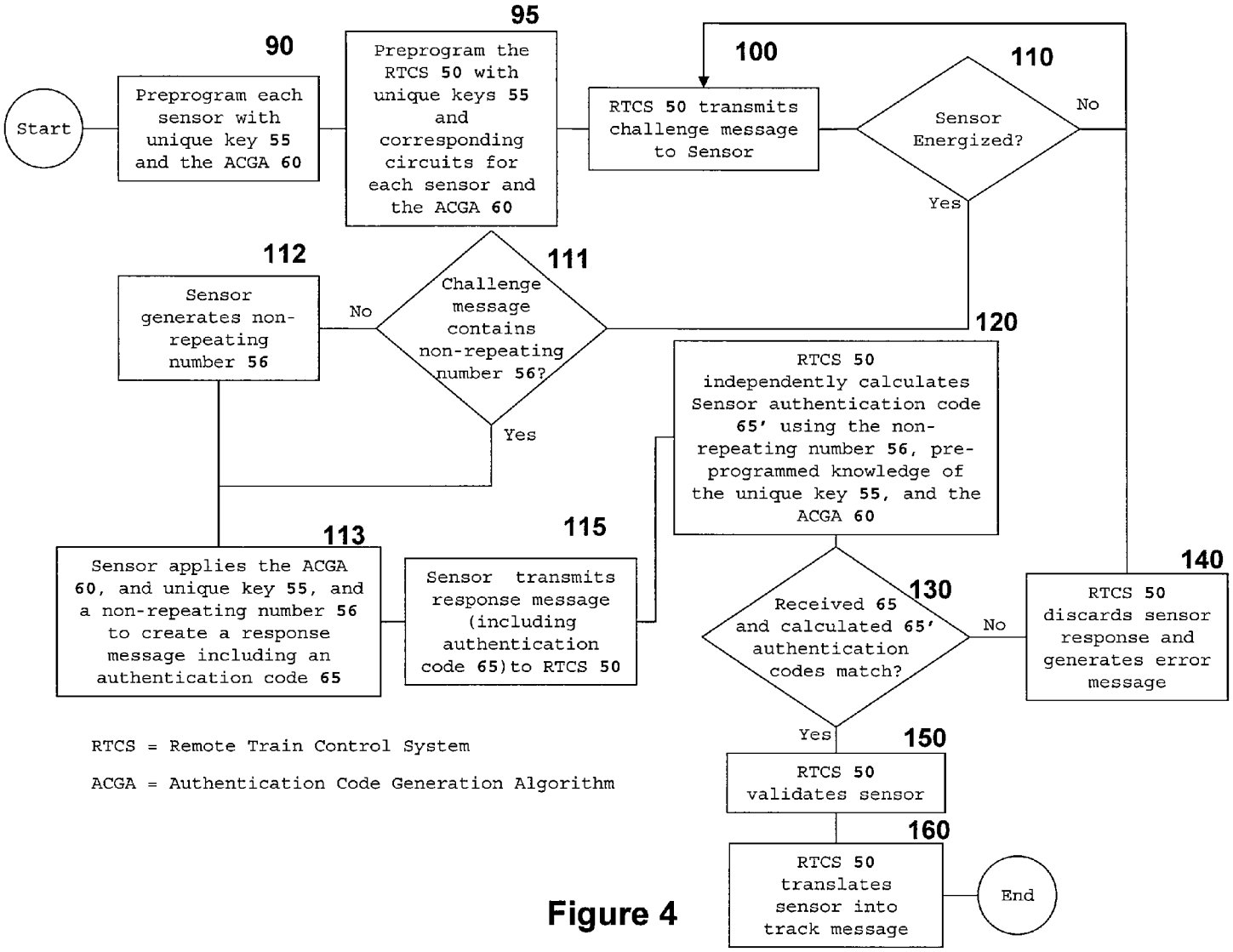
FIG. 4 is a flowchart representing the steps performed by the railroad signaling and communication system for verifying trackside conditions of the present invention in an embodiment without a master microprocessor.

Referring now to FIG. 4, each sensor 1 is pre-programmed with a unique key 55 and an authentication code generation algorithm 60. The remote train control system 50 is pre-programmed with knowledge of the unique keys 55 for and the corresponding circuits to which each of the sensors 1 are connected and the authentication code generation algorithm 60. To verify track status, the remote train control system 50 transmits a challenge message requesting sensor status to a particular sensor 1 on its route (100). If the sensor 1 is energized (110), the sensor 1 uses its unique key 55 as an input to the authentication code generation algorithm 60, thereby creating a response message (113) including an authentication code 65. The sensor 1 transmits the response message (115) to the remote train control system 50. In one embodiment, the authentication code generation algorithm 60 requires two pieces of information to generate an authentication code 65: the unique key 55 for the particular sensor 1 and a non-repeating number 56 such as a time stamp. Upon receipt of the challenge message, the energized sensor 1 uses its unique key 55 and the non-repeating number 56 as inputs to the authentication code generation algorithm 60, thereby creating a response message (113). The non-repeating number 56 may be provided by either the remote train control system 50 or the sensor 1 (112). If the non-repeating number 56 is provided by the remote train control system 50, the non-repeating number 56 is transmitted to the sensor as part of the challenge message (100). If the non-repeating number 56 is provided by the sensor 1, the non-repeating number 56 is transmitted to the remote train control system 50 as part of the response message (115).

The remote train control system 50 independently calculates an authentication code 65' for the requested sensor 1 using a priori knowledge of the authentication code generation algorithm 60 and the unique key 55 for the particular sensor 1 located on the chosen route (120). The remote train control system 50 compares the calculated authentication code 65' to the received authentication code 65 to determine if they match (130). If the calculated 65' and received 65 authentication codes match, the remote train control system 50 validates the received sensor (150), and translates the received sensor into a track status message 160, such as switch in normal position or track available, for utilization by the locomotive engineer or electronic control system to control the movement of the locomotive. If the calculated 65' and received 65 codes do not match, the remote train control system 50 discards the response message and generates an error message (140). The error message may trigger another challenge message.

The unique key 55 and authentication code generation algorithm 60 provide a means for the remote train control system to identify corrupted messages and messages from the wrong source. Additionally, the use of a non-repeating number 56 with the unique key 55 and authentication code generation algorithm 60 provides a means for the remote train control system to identify stale messages.

Those of skill in the art will recognize that many different authentication code generation technologies could be used to create authentication codes and many different transmission schemes could be employed to transmit the authentication codes 65 from the sensors 1 to the remote computer process 50. In one embodiment, the authentication code generation algorithm 60 is a Hashed Message Authentication Code (HMAC). Each sensor 1 is programmed and configured with a unique key 55 and the HMAC algorithm. The remote train control system 50 is pre-programmed with knowledge of the circuit connected to each sensor 1, a unique key 55 for each sensor 1 and the HMAC algorithm. Upon receipt of a challenge message from the remote train control system 50, the energized sensor (110) applies the HMAC algorithm to the unique key 55 and, in some embodiments, the non-repeating number 56 generated either by the remote train control system 50 or the sensor 1 to produce a HMAC (113). The sensor 1 transmits the HMAC to the remote train control system 50 as part of the response message (115). The remote train control system 50 independently calculates the HMAC for the requested sensor 1 using the a priori knowledge of the HMAC algorithm, in some embodiments the non-repeating number 56, and the unique key 55 for the particular sensor 1 located on the chosen route (120).

In another embodiment, a trackside master microprocessor 30 is used as shown in FIG. 2. The master microprocessor 30 is in two-way communication with the sensors 1 and with the remote train control system 50. In some embodiments utilizing a master microprocessor 30 as shown in FIG. 3, a group or cluster 40 of sensors 1 is assigned to a particular master microprocessor 30. For example, a cluster 40 may be comprised of all the sensors 1 at a particular trackside installation and assigned to a master microprocessor 30 at that particular trackside installation. Each sensor 1 in the cluster 40 communicates with the particular master microprocessor 30 assigned to its cluster 40. Since all sensors 1 across all clusters 40 have globally unique identifiers (unique keys 55), the remote train control system 50 may use the pre-programmed sensor key 55 and corresponding circuit associated with the sensor 1 to validate sensors 1 in the same cluster 40 or across multiple clusters 40.

Figure 5:
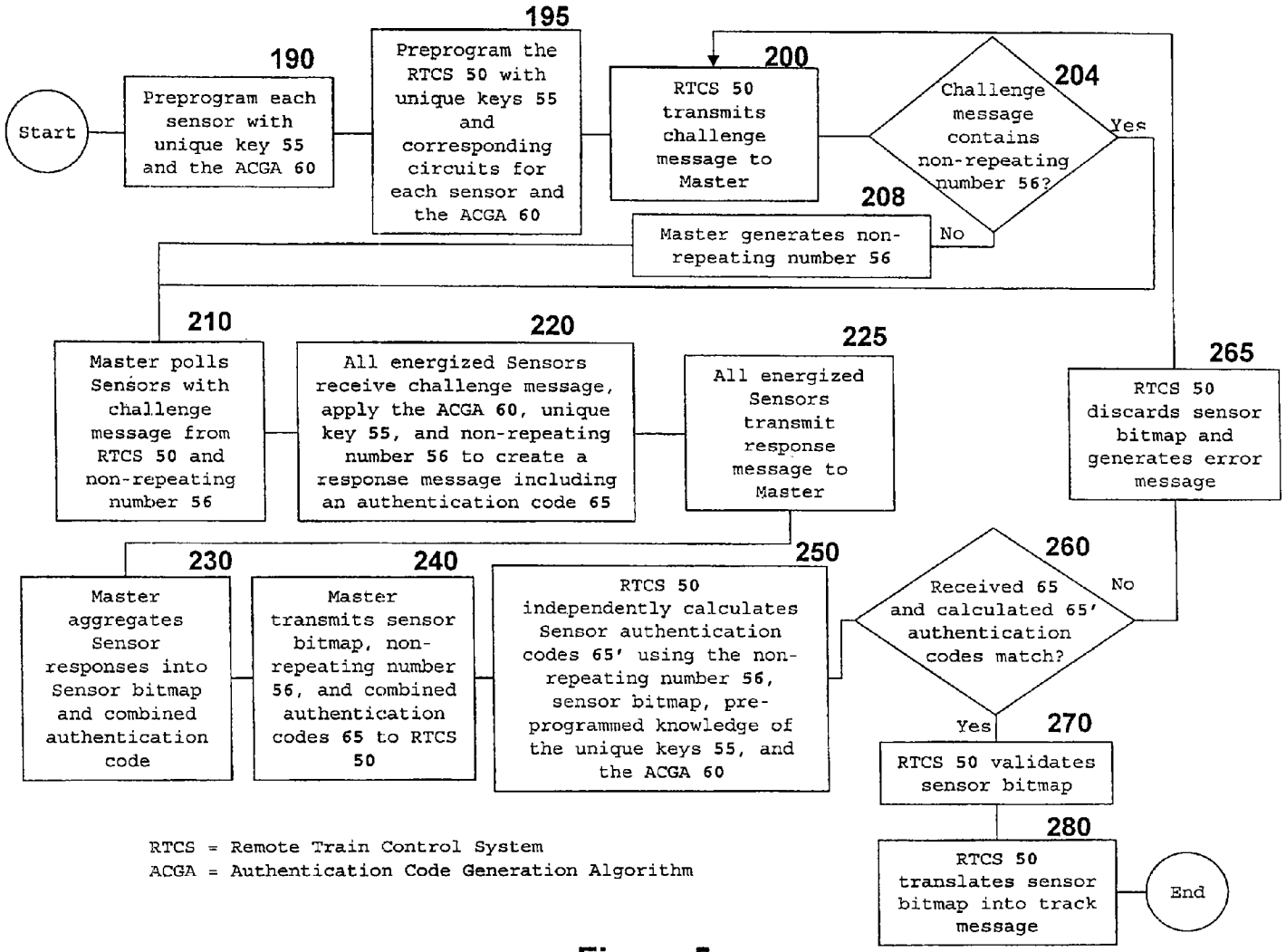
FIG. 5 is a flowchart representing the steps performed by the railroad signaling and communication system for verifying trackside conditions of the present invention in an embodiment with a master microprocessor.

Referring now to FIG. 5, the verification method may alternatively use a trackside master microprocessor 30. In this embodiment, each sensor 1 for providing trackside conditions to a remote train control system 50 is pre-programmed with a unique key 55 and an authentication code generation algorithm 60. The remote train control system 50 is pre-programmed with knowledge of the unique keys 55 and the corresponding circuits to which each of the sensors 1 are connected and the authentication code generation algorithm 60. The authentication code generation algorithm 60, such as the HMAC algorithm, is not programmed into the master microprocessor 30 and the master microprocessor 30 is not capable of authenticating the messages from the sensors 1. The remote train control system 50 transmits a challenge message requesting sensor status to a particular master microprocessor 30 on a particular train's route 200. The master microprocessor 30 sequentially polls each of the sensors 1 in communication with the master microprocessor 30 requesting sensor status (210). Each sensor 1 is pre-programmed with a unique key 55 and an authentication code generation algorithm 60. The remote train control system 50 is preprogrammed with knowledge of at least one of the unique keys 55 and the corresponding circuit to which the at least one sensor 1 is connected and the authentication code generation algorithm 60. If the sensor 1 is energized, the sensor 1 uses its unique key 55 as an input to the authentication code generation algorithm 60, thereby creating a response message (220) including an authentication code 65. The sensor 1 transmits the response message (225) to the master microprocessor 30. The master microprocessor 30 combines the received sensor responses into an aggregate authentication message comprising a sensor bitmap and combined authentication code (230) and transmits the aggregate message (240) to the remote train control system 50.

In another embodiment, to protect against stale messages, the authentication code generation algorithm requires two pieces of information to generate an authentication code: the unique key 55 for the particular sensor 1 and a non-repeating number 56 such as a time stamp. The non-repeating number 56 may be provided by either the remote train control system 50 or the master microprocessor 30 (not shown). If the non-repeating number 56 is provided by the remote train control system 50, the non-repeating number 56 is transmitted to the master microprocessor 30 as part of the challenge message (200). If the non-repeating number 56 is provided by the master microprocessor 30, the non-repeating number 56 is created (208) by the master microprocessor 30 upon receipt of the challenge message and transmitted to the sensors 1 during polling (210). The polling message includes both a request for status and a non-repeating number 56. If the sensor 1 is energized, upon receiving the polling message from the master microprocessor 30, the sensor 1 applies the authentication code generation algorithm 60 to the polling message thereby creating a response message (220). The sensor 1 transmits the response message (225) to the master microprocessor 30. The master microprocessor 30 combines the received sensor responses into an aggregate authentication message comprising a sensor bitmap, combined authentication code 65, and the non-repeating number 56 (230) and transmits the aggregate message (240) to the remote train control system 50.

The remote train control system 50 independently calculates the sensor authentication codes 65' for the sensors 1 in the requested cluster 40 using the a priori knowledge of the authentication code generation algorithm 60, the unique keys 55 for the particular sensors 1 located in the cluster 40 on the chosen route, and, in some embodiments, also uses the non-repeating number 65 (250). The remote train control system 50 compares the calculated authentication code 65' to the received authentication codes 65 to determine if they match (260). If the calculated authentication code 65' and received authentication code 65 match, the remote train control system 50 validates the received sensor bitmap (270) and translates the received sensor bitmap into a track status message based on which sensors are energized (280), such as switch in normal position or track available, for utilization by the locomotive engineer or electronic control system to control the movement of the locomotive. If the calculated 65' and received 65 codes do not match, the remote train control system 50 discards the response message and generates an error message (265). The error message may trigger another challenge message.

Those of skill in the art will recognize that many different authentication code generation technologies could be used to create authentication codes 65 and many different transmission schemes could be employed to transmit the authentication codes 65 from the sensors to the remote train control system 50. In one embodiment, each sensor is programmed and configured with a unique private key 55 and a Hashed Message Authentication Code (HMAC) algorithm 61. The remote train control system 50 is pre-programmed with knowledge of the circuit to which each sensor is electrically connected, a unique key 55 for each sensor 1 and the HMAC algorithm 61.

Utilizing a master microprocessor 30 to transmit an aggregate message to the remote train control system is beneficial because it reduces the bandwidth used without sacrificing data security. System security is maintained even with the introduction of the master microprocessor 30 because the master microprocessor 30 can not generate any valid authentication codes.

Thus, it is seen that the method and system for verifying the status of trackside signals and switches in safety critical railroad applications of the present invention readily achieves the ends and advantages mentioned as well as those inherent therein. While certain preferred embodiments of the invention have been illustrated and described for the purposes of the present disclosure, it is recognized that these embodiments are not intended to be limiting, and that departures may be made therefrom within the scope of the invention and that numerous modifications may be made by those skilled in the art, which changes are encompassed within the scope and spirit of the present invention as defined by the following claims.

We claim:

1. A railroad signaling and communication system for verifying trackside conditions which are used to control train movement in safety critical railroad. applications comprising:

a voltage sensor for providing trackside conditions to a remote train control system; said voltage sensor having a low power microprocessor and a two-way electronic communication means for communicating with the remote train control system; and said voltage sensor being electrically connected to a trackside circuit for providing trackside conditions to a railroad interlocking, said circuit comprising a power supply, the interlocking, and a trackside signaling electrical component, said sensor being electrically intermediate to said electrical component and said interlocking to sense the voltage between said electrical component and said interlocking, said circuit energized when said electrical component is engaged, said sensor powered by voltage applied to said circuit such that said sensor is energized only when said electrical component is engaged.

2. The railroad signaling and communication system of claim 1 wherein:

said circuit is an input circuit having at least three nodes: A, B, and C;

said electrical component electrically connected to said circuit and positioned between nodes A and B;

said sensor electrically connected to said circuit and positioned between nodes B and C;

said interlocking electrically connected to said circuit and positioned between nodes A. B, and C; and said power supply electrically connected to said circuit and positioned between nodes A and C such that a positive terminal of said power supply is adjacent to node A and a negative terminal of said power supply is adjacent to node C;

whereby when said electrical component is engaged energizing said sensor, a track condition input is provided to said interlocking.

3. The railroad signaling and communication system of claim 2 wherein:

said electrical component is selected from the group consisting of relays, switch contacts and hazard detectors.

4. The railroad signaling and communication system of claim 1 wherein:

said circuit is an output circuit having at least four nodes: A, C, D, and E;

said interlocking electrically connected to said circuit and positioned between nodes A, C, D, and E;

said sensor electrically connected to said circuit and positioned between nodes D and E;

said electrical component electrically connected to said circuit and positioned between nodes D and E in parallel to said sensor; and said power supply electrically connected to said circuit and positioned between nodes A and C such that a positive terminal of said power supply is adjacent to node A and a negative terminal of said power supply is adjacent to node C;

whereby when said interlocking generates an output energizing said output circuit and said sensor, a track status output is provided to said electrical component.

5. The railroad signaling and communication system of claim 4 wherein:

said electrical component is a signal lamp.

6. The railroad signaling and communication system of claim 1 further comprising:

a plurality of electrical components each electrically connected to said interlocking and said power supply creating a plurality of circuits; and a plurality of voltage sensors, each sensor electrically connected to one of said circuits.

7. The railroad signaling and communication system of claim 6 wherein:

at least one of said circuits is an input circuit having at least three nodes: A, B, and C wherein one of said electrical components is electrically connected to said input circuit and positioned between nodes A and B, one of said sensors is electrically connected to said input circuit and positioned between nodes B and C;

said interlocking is electrically connected to said circuit and positioned between nodes A, B. and C; and said power supply is electrically connected to said circuit and positioned between nodes A and C such that a positive terminal of said power supply is adjacent to node A and a. negative terminal of said power supply is adjacent to node C whereby when said electrical component is engaged energizing said sensor, a track condition input is provided to said interlocking; and at least one of said circuits is an output circuit having at least four nodes: A, C, D, and E, said interlocking electrically connected to said output circuit and positioned between nodes A, C, D, and E, one of said sensors is electrically connected to said output circuit and positioned between nodes D and E, one of said electrical components is electrically connected to said output circuit and positioned between nodes D and E in parallel to said one of said sensors; and said power supply electrically connected to said output circuit and positioned between nodes A and C such that a positive terminal of said power supply is adjacent to node A and a negative terminal of said power supply is adjacent to node C;

whereby when said interlocking generates an output energizing said output circuit and said sensor, a track status output is provided to said electrical component.

8. The railroad signaling and communication system of claim 1 wherein:

said two-way electronic communication means is a wireless communication means.

9. The railroad signaling and communication system of claim 1 wherein:

said two-way electronic communication means further comprises a. transmitter and a receiver; and said transmitter only powers on when it is sending a message to reduce power consumption.

10. The railroad signaling and communication system of claim 1 further comprising:

a trackside master microprocessor for communicating with said sensors and said remote train control system, said master microprocessor having a two-way electronic communications means.

11. The railroad signaling and communication system of claim 10 wherein:

said two-way electronic communication means is a wireless communication means.

12. The railroad signaling and communication system of claim 10 wherein:

said two-way electronic communication means further comprises a transmitter and a receiver; and said transmitter only powers on when it is sending a message.

13. A failsafe system for verifying the status of a trackside signaling electrical component comprising:

said trackside signaling electrical component;

a power source;

an interlocking; and a voltage sensor, said voltage sensor having a low power microprocessor and a two-wav electronic communication means for commumicating with the remote train control system, wherein the trackside electrical component, the power source, the interlocking, and the voltage sensor are arranged in an electrical circuit such that the voltage sensor senses the voltage between said trackside signaling electrical component and said interlocking and is energized only when the trackside electrical. component is energized.

* * * * *